US008714284B2

(12) United States Patent
Cote

(10) Patent No.: US 8,714,284 B2
(45) Date of Patent: May 6, 2014

(54) WEIGHT-ON-BIT DRILL SUB

(75) Inventor: Bradley R. Cote, Calgary (CA)

(73) Assignee: BBJ Tools Inc., Calgary (CA)

( * ) Notice: Subject to any disclaimer, the term of this patent is extended or adjusted under 35 U.S.C. 154(b) by 456 days.

(21) Appl. No.: 12/883,851

(22) Filed: Sep. 16, 2010

(65) Prior Publication Data

US 2012/0067645 A1 Mar. 22, 2012

(51) Int. Cl.
*E21B 21/08* (2006.01)
*E21B 17/07* (2006.01)

(52) U.S. Cl.
USPC ..... 175/321; 175/48; 166/250.01; 73/152.22; 285/298

(58) Field of Classification Search
USPC ..... 175/27, 48, 321, 293, 305; 166/250.01; 73/152.22, 152.43; 285/298–301, 224, 285/237
See application file for complete search history.

(56) References Cited

U.S. PATENT DOCUMENTS 1,891,329 A * 12/1932 Le Compte et al. ..... 173/3
2,764,310 A 9/1956 Bendar
3,466,597 A 9/1969 Richter, Jr. et al.
3,864,968 A 2/1975 Anderson
4,120,198 A 10/1978 Tanguy et al.
4,359,898 A 11/1982 Tanguy et al.
4,359,899 A 11/1982 Garney
4,901,806 A 2/1990 Forrest
5,386,724 A 2/1995 Das et al.
5,795,991 A 8/1998 Hesse et al.
5,806,611 A 9/1998 Van Den Steen et al.
6,802,215 B1 10/2004 Boucher et al.
6,957,575 B2 10/2005 Boucher et al.

FOREIGN PATENT DOCUMENTS

CA 1011962 6/1977

* cited by examiner

*Primary Examiner* — Shane Bomar
*Assistant Examiner* — Catherine Loikith
(74) *Attorney, Agent, or Firm* — Bennett Jones LLP

(57) ABSTRACT

An apparatus and method for producing pressure signals which indicate when weight-on-bit, during the drilling of a wellbore, exceed a predetermined, upper limit. The apparatus includes a first mandrel and a second mandrel that inserts into and is axially moveable within the first mandrel. The position of the second mandrel may be dependent upon the balance of a biasing member's biasing strength and the weight-on-bit exerted on the drill bit. If weight-on-bit values overcome the biasing strength of the biasing member, the second mandrel may move uphole within the first mandrel and create a pressure signal that is detectable at surface so that the operator is made aware that weight-on-bit values exceed the upper limit.

16 Claims, 3 Drawing Sheets

WEIGHT-ON-BIT DRILL SUB

FIELD

The present invention relates to an apparatus and method for detecting pre-determined weight-on-bit forces while drilling wellbores.

BACKGROUND

Access to subterranean oil or gas reservoirs may be gained by drilling a wellbore through the earth. In traditional (i.e. substantially vertical) wellbore drilling, advancement of the drill bit is achieved by the application of torsional and axial forces on the drill bit. Torsional forces can be generated at surface by a drilling rig rotating a drill string or downhole by a downhole motor that rotates the drill bit with or without also having rotation of the drill string.

Axial forces may be generated by the incorporation of heavy drill collars in-line with, or as part of, the drill string often in proximity to the drill bit. The axial forces generated by the drill collars can be modulated by changing the surface hook load. When directionally drilling, thrusters can be used to increase the driving force on the drill bit. For the purposes of this disclosure the axial driving force on the drill bit will be referred to as weight-on-bit (WOB).

For a given drilling scenario the operator may determine an optimal range with an upper limit of WOB values, perhaps depending upon the type and manufacture of the drill bit, the depth of drilling and the geological formations to be drilled through. Drilling operators may desire to monitor WOB in order to remain below the upper limit of WOB values to maintain drilling efficiency.

As an additional element of drilling wellbores, drilling fluids are typically pumped from surface through a central bore in the drill string to the drill bit. Drilling fluids may help lubricate and cool the drill bit while drilling in efforts to mitigate deterioration of the drill bit. Drilling fluids may also return to surface, clearing cuttings away from the drill bit.

The monitoring of axial forces on a drill bit during drilling operations, termed weight-on-bit, can assist the operator with maintaining drilling efficiency. For example, if weight-on-bit is greater than a predetermined upper limit the drill bit may deteriorate faster. Replacement of a drill bit may require extraction of the entire drill string, which can be very costly.

SUMMARY

In accordance with a broad aspect of the present invention there is provided an apparatus for signaling when a weight-on-bit value is greater than an upper limit during the drilling of wellbores, the apparatus comprising: a tubular body for connection within a drill string including a first mandrel and a second mandrel, and a central bore defining a longitudinal axis of the tubular body and creating a flow path permitting a flow of fluids between the two mandrels and through the tubular body, the second mandrel secured, at least partially, within an annular bore of the first mandrel so that the second mandrel is telescopically arranged with and axially moveable within the first mandrel between a telescopically extended position and a compressed position; a biasing member that biases the first mandrel and the second mandrel into the telescopically extended position, the biasing member having a biasing strength; and a first sealing part and a second sealing part; one sealing part being secured to the first mandrel and the other sealing part being secured to the second mandrel, both sealing parts being within the fluid flow path of the tubular body, the first sealing part and the second sealing part are positioned to come together when the biasing strength of the biasing member is overcome by the weigh-on-bit, together the sealing parts form a fluid seal in the central bore to prevent the flow of fluids through the tubular body.

In accordance with a broad aspect of the present invention there is provided a method for detecting if weight-on-bit values exceed an upper limit during the drilling of wellbores, the method comprising: determining the upper limit of weight-on-bit values; selecting a biasing member strength at least equal to weight-on-bit values; providing an apparatus to produce the pressure signal including: a tubular body for connection within a drill string including a first mandrel and a second mandrel, with a central bore defining a longitudinal axis of the body and permitting the flow of fluids between the two mandrels and through the tubular body; the second mandrel secured, at least partially, within an annular bore of the first mandrel so that the second mandrel is telescopically arranged with and axially moveable within the first mandrel between a telescopically extended position and a compressed position; a biasing member having the selected biasing member strength to bias the first mandrel and the second mandrel into the telescopically extended position; and a first sealing part and a second sealing part; one sealing part being secured to the first mandrel and the other sealing part being secured to the second mandrel, both sealing parts being within the fluid flow of the tubular body, the first sealing part and the second sealing part are positioned to come together when the biasing strength of the biasing member is overcome by the weight-on-bit, together the sealing parts form a fluid seal in the central bore to prevent the flow of fluids through the tubular body. The method including connecting the apparatus in-line with a drilling string so that the position of second mandrel in the first mandrel is dependent upon the balance of the biasing strength of the biasing member and an axial driving force on a drill bit; applying torsional and axial forces on the drill string to drill a wellbore; pumping of drilling fluids through the drill string; and monitoring drilling fluid pressure to detect the formation of the fluid seal in the apparatus.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the Figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

For the sake of clarity, within this description, the terms "up", "uphole", "upper", "above" generally refer to the direction within the wellbore towards the surface. Likewise, the terms "down", "downhole", "lower", "below" make reference to the direction within the wellbore away from surface. The terms "inner" and "inward" refer to the direction towards the center of a wellbore, whereas the terms "outer" and "outward" refer to the direction away from the center of a wellbore, for example towards the well bore wall. As those skilled in the art of well bore drilling can appreciate these terms are similarly relevant to deviated and directionally drilled well bores and the tools used therein.

Figure 1:
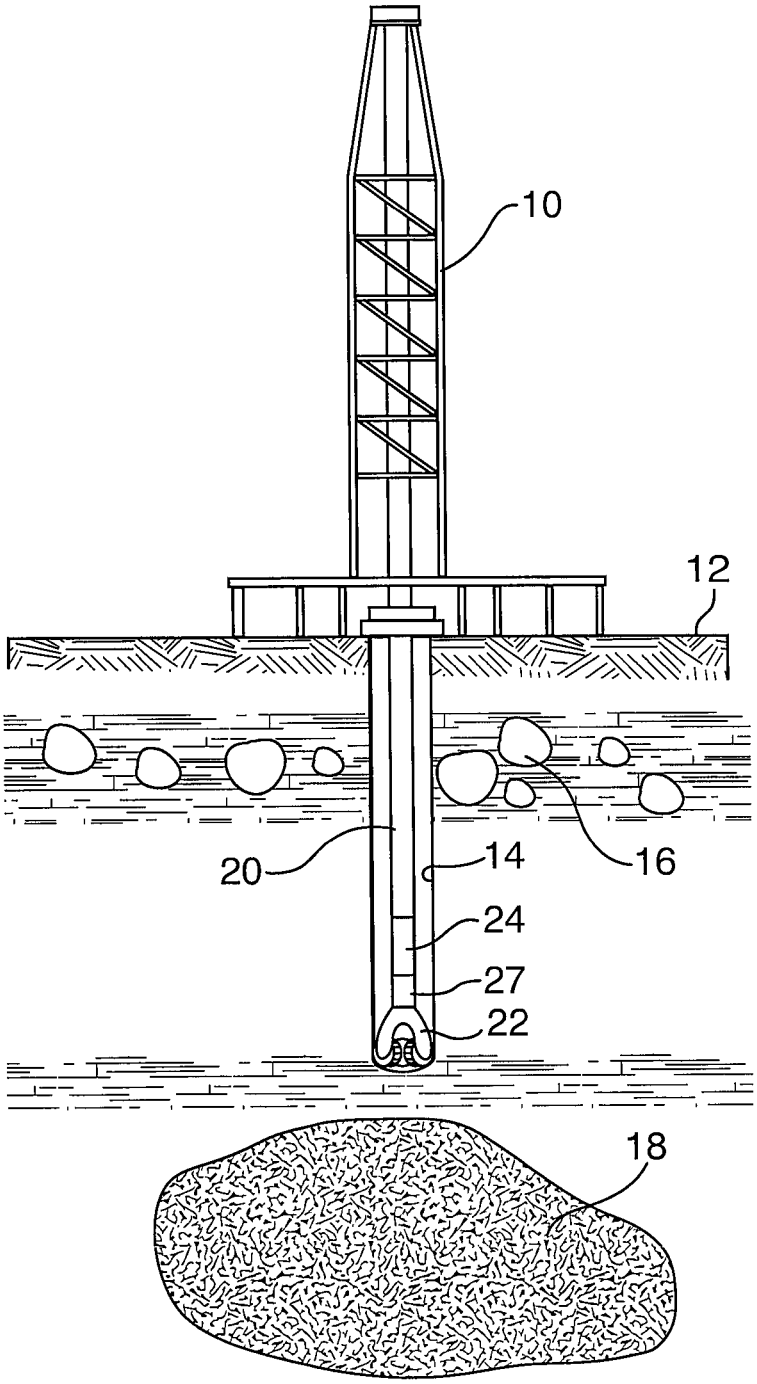
FIG. 1 is a schematic representation of a typical well bore drilling scenario with one embodiment of the apparatus connected in-line with a drill string.

A typical drilling rig 10 is shown on the surface 12 with a well bore 14 being drilled through subterranean formations 16 towards a target reservoir 18, as shown in FIG. 1. Within the wellbore, a drill string 20 is depicted including a drill bit 22 and a tubular body 24 is shown incorporated with the drill string. Drilling rig 10 or a downhole motor (not shown) or any other method known in the art may provide the torsional force on the drill bit. The drill string may include any number and variety of downhole elements 27 such as tools, drill string subs including measurement-while-drilling tools, drill collars, sensors and the like.

The present invention provides an apparatus and method that allows the operator of a drilling operation to know when axial forces, termed weight-on-bit (WOB), exceed a predetermined upper-limit. The apparatus may telescopically compress in response to WOB values and when WOB exceeds an upper limit a fluidic seal may be created within the apparatus that causes the generation of a pressure signal, detectable at surface, in the drilling fluids being pumped downhole from surface.

Figure 2A:
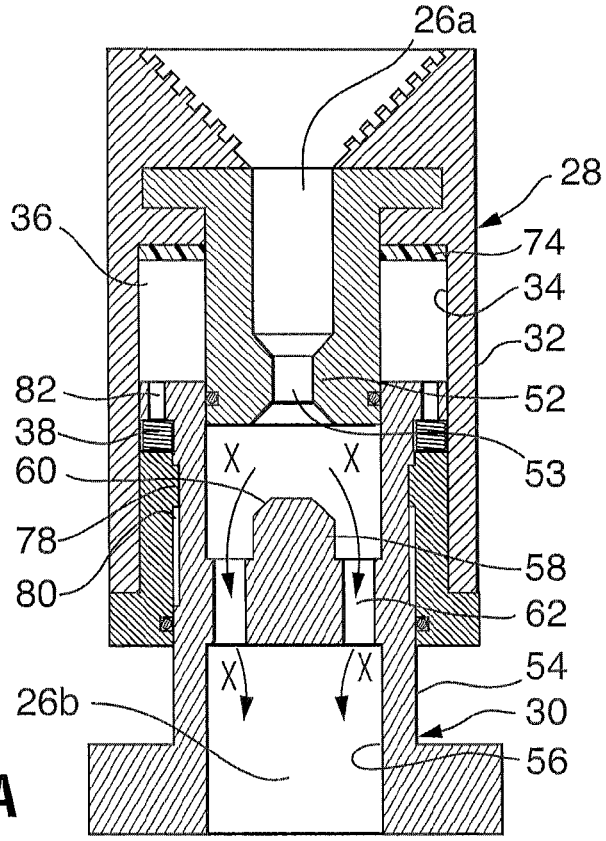
FIG. 2A is a side elevation, sectional view of one embodiment of the apparatus in an extended position.
Figure 2B:
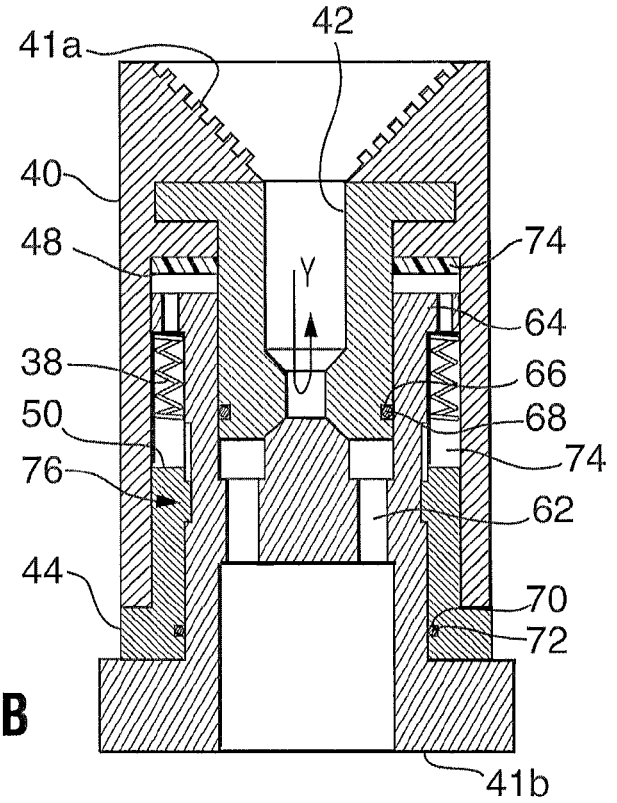
FIG. 2B is a side elevation, sectional view of one embodiment of the apparatus in a sealing position.

For example, with reference to FIGS. 2A and 2B, the present invention may provide an apparatus for creating a pressure signal when a WOB value is greater than a predetermined upper limit during the drilling of a wellbore. The apparatus may comprise a tubular body 24 for connection within a drill string 20 including a first mandrel 28 and a second mandrel 30. The tubular body may also include a central bore 26 defining the longitudinal axis of the body and permitting the flow of fluids, for example drilling mud, through the tubular body. The second mandrel may be secured, at least partially, within an annular hollow chamber 36 of the first mandrel so that the second mandrel is telescopically arranged with, and axially moveable, within the first mandrel. The apparatus may further include a biasing member 38 that biases the two mandrels apart because the biasing member has a biasing strength. A first sealing part 52 and a second sealing part 58 may form part of the apparatus with one sealing part secured to the first mandrel and the other sealing part secured to the second mandrel and both sealing parts are, at least partially, within the fluid flow of the tubular body. The first sealing part and the second sealing part may be positioned to come together if the WOB forces exceed the biasing strength of the biasing member. When the sealing parts come together they may form a fluid seal in the central bore to prevent the flow of fluids through the tubular body.

The central bore may provide a conduit so that if the apparatus is connected into the drill string the central bore becomes continuous with the bore of the drill string. This may be of interest for the pumping of drilling fluids from the surface through the drill string and the body to a drill bit.

The body may include the first mandrel and the second mandrel with the central bore extending through both mandrels. The first mandrel may include an outer wall 32 and an inner wall 34, the later which defines the central bore passing through the first mandrel. The inner wall may be stepped to form other areas such as annular hollow chamber 36 in which the second mandrel is positioned. In this embodiment, the first mandrel is depicted as positioned uphole from the second mandrel and the second mandrel may insert into and be moveable within first mandrel so that the body has a limited range of telescopic movement.

The uphole end of the first mandrel may be connectable into the drill string through a tubular connection 41*a*, for example a threaded box or pin arrangement or any other tubular connection. In one embodiment, first mandrel 28 may include an inner sleeve 42 that forms an extension of portion 26*a* of the central bore. Inner sleeve 42 extends into the annular hollow chamber 36 generally coaxially with and spaced from inner wall 34. Inner sleeve 42, therefore defines an inner limit of chamber 36, such that chamber 36 is defined as an annular space defined between wall 34 and sleeve 42. The inner sleeve may include first sealing part 52 that extends on its inner diameter into the central bore. For example, the first sealing part may form an annular disk or a seat with a central aperture 53. The first sealing part may extend into central bore to such an extent that fluid flow is not substantially restricted through the central aperture. In an alternate embodiment, first sealing part may extend across central bore and have ports, rather than a central aperture, therethrough to permit the substantially unrestricted fluid flow past first sealing part.

Having described the various embodiments of the elements associated with the first mandrel, the description now turns to the second mandrel, with one embodiment thereof depicted in FIGS. 2A and 2B. The second mandrel may connect into the drill string, the drill bit via tubular connections 41*b* and methods such as box or pin threading, etc.

The second mandrel may include an outer wall 54 and an inner wall 56, the later which defines the central bore through the second mandrel. The second mandrel may insert into the first mandrel and have a limited range of telescopic movement therein. For example, the second mandrel may be inserted in annular chamber 36 with at least a portion of outer wall 54 axially slidable along wall 34 and inner wall 56 facing the outer surface of inner sleeve 42.

Extending inwardly from the inner wall and into central bore 26 may be a second sealing part 58. The second sealing part may include a profile portion 60, which can engage and create a fluidic seal with the first sealing part of the first mandrel. In general, the second sealing part may be a variety of relevant shapes such as a dart, a ball point, conical, frustoconical, pyramidal and the like.

Regardless of the specific shape, the second sealing member may have one or more flow ports 62 to permit the flow of drilling fluid to pass there through and access the central bore of the drill string downhole of the second mandrel (see flow direction represented by lines X in FIG. 2A). The flow ports can be any shape or size to permit such flow of drilling fluid.

As will be discussed further below, the flow ports may be positioned so that if the matching profile portion engages the first sealing part drilling fluids cannot flow past the first sealing part to access the central bore there below. Further, the sealing parts are positioned on their respective mandrels such that the sealing parts come together when the mandrels are telescopically compressed to the degree indicative of a maximum WOB value.

Figure 3A:
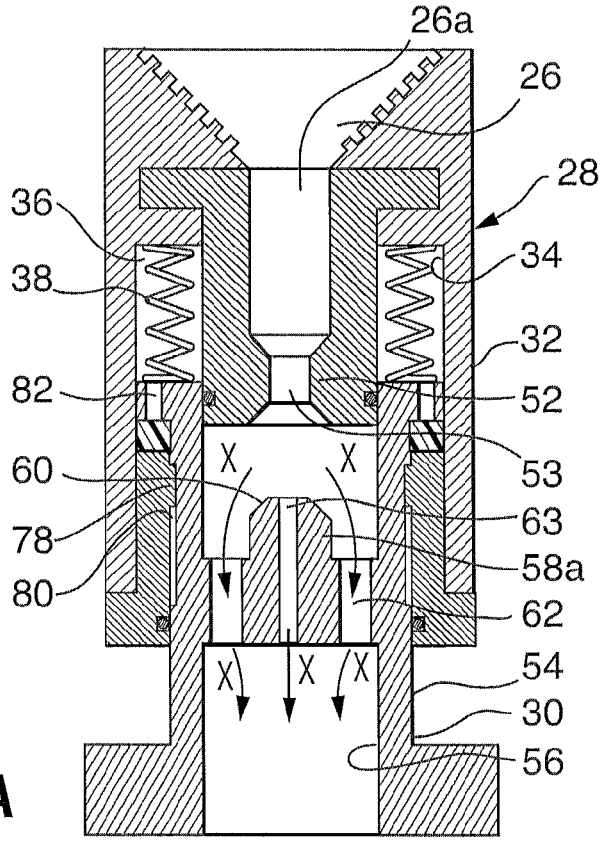
FIG. 3A is a side elevation, sectional view of another embodiment of an apparatus in an extended position.
Figure 3B:
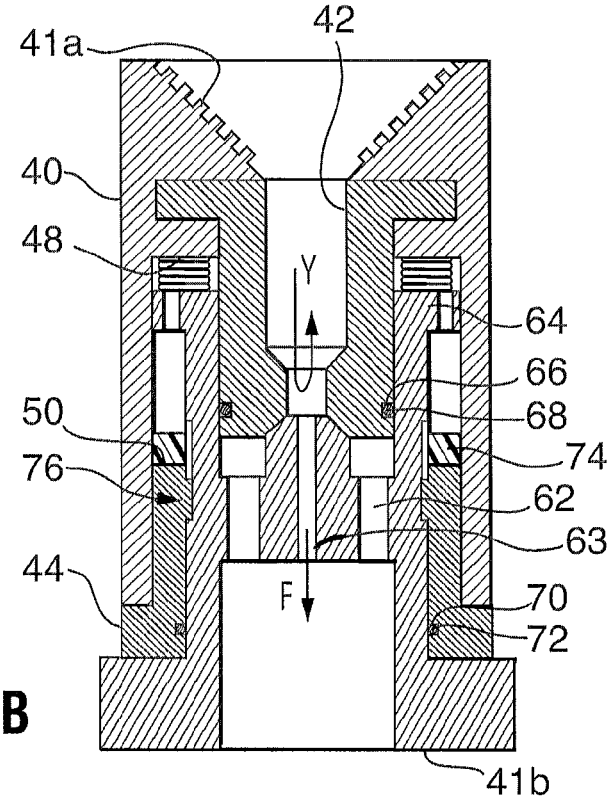
FIG. 3B is a side elevation, sectional view of the embodiment of FIG. 3A in a compressed position.

In an alternative embodiment (shown in FIGS. 3A and 3B), where it is not desirable to create a perfect seal in the apparatus, second sealing part 58*a* may also have apertures 63 or the first sealing part may have apertures, to permit the communication of fluids across the second sealing part even when the first sealing part and the second sealing part come together. Apertures 63 may permit fluidic communication there across so that drilling fluids may have a restricted flow (arrow F) past the second sealing part even if matching profile 60 is sealed in the first seal part. As such, although sealing of the parts is contemplated to form a pressure pulse, such a seal may not be a perfect seal.

In one embodiment, the uphole end of second mandrel may include a flange 64 that extends outward therefrom. The flange may, for example, be integral such as a lateral extension of the second mandrel or an additional component secured to the second mandrel such as a safety clip. The flange may extend, at least partially, radially out beyond ledge 50. The engagement of flange 64 with ledge 50 may define the lower end of the limited range of telescopic movement, as shown in FIG. 2A. A biasing member 38 may act between first mandrel and second mandrel 30 to bias them axially apart. The biasing member, in this illustrated embodiment, is disposed in an annular hollow chamber between end wall 48 and mandrel 30. The upper end of the limited range of telescopic movement may be defined by the biasing member that is fully compressed between the end wall and the flange, as shown in FIG. 2B.

Biasing member 38 may be housed within the annular hollow chamber with one end of biasing member adjacent to the end wall and the other end of the biasing member may be adjacent to upper edge of the second mandrel. In particular, the flange and the uphole end of the second mandrel may provide a face that engages the lower end of the biasing member within the annular hollow chamber. Biasing member 38 may be any conventional biasing member such as, for example, a compression spring. As a further example, compression springs may be Belleville springs, coiled compression springs, helical springs, variable pitch concial springs and the like.

A coiled compression spring may have a known, constant biasing strength that allows the spring to resist applied compressive forces to a predictable degree. If the compressive forces exceed the biasing strength constant limit, the spring will compress. As will be described further below, the biasing member acts between the two mandrels to bias them away from each other and in particular, to resist them from compressing in to further overlapping relation.

The outer surface of the inner sleeve may have an inner annular gland 66 to house an inner sealing member 68. The inner annular gland may be a rounded groove, a square cut groove, an indentation etc. In the illustrated embodiment of FIGS. 2A and 2B, the inner annular gland is square cut. The inner sealing member may be an o-shaped sealing ring that protrudes from the inner annular gland so that the sealing member may be compressed between the inner annular gland and the inner surface of the second mandrel creating therebetween a pressure and fluid seal to prevent fluidic communication between the central bore and the annular hollow chamber. It is to be understood herein that the term "sealing member" will, unless otherwise specified, refer to sealing members composed of materials suitable to create and sustain a seal against the pressures associated with a downhole wellbore drilling environment.

The inner surface of the lower sleeve may have a lower annular gland 70 to house a lower sealing member 72. The lower annular gland may be a rounded groove, a square cut groove, an indentation etc. In the illustrated embodiment of FIG. 2, the lower annular gland is square cut. The lower sealing member may be an o-shaped sealing ring that protrudes from the lower annular gland so that the lower sealing member may be compressed between the lower annular gland and the outside surface of the second mandrel creating therebetween a pressure and fluid seal to prevent fluidic communication between the wellbore and the annular hollow chamber.

In another embodiment of the present invention, flange 64 may include ports 82 to permit the bi-directional flow of fluids therethrough to decrease the likelihood of a pressure build up on either side of the flange. As one can appreciate, such a pressure lock would impair the functionality of the invention.

In one embodiment of the present invention, a dampener 74 may be installed between the upper side of ledge 50 and the lower side of the flange to mitigate possible shocks to elements of, or the entirety of, the drill string that may be caused by the second mandrel abruptly shifting to an extended position thereby causing the flange to strike the ledge. Such an abrupt positional shift of the second mandrel may occur, for example, if the operator eliminates the axial forces upon the drill bit. The dampener may, for example, be an elastomeric bumper, springs or the like that can dampen such collision forces that may be associated with a downhole wellbore drilling environment.

In another embodiment of the present invention, the lower sleeve and the second mandrel may have a transmission arrangement 76 to permit the transmission of torsional forces there between. The transmission arrangement may, for example, be a tongue-and-groove arrangement. The transmission arrangement may include the lower sleeve having one or more splines 78 that engage and axially move within one or more receiving grooves 80 on the outer wall of second mandrel that mate with the one or more splines, or vice versa, the one or more splines may be included on the outer wall of second mandrel and the one or more receiving grooves may be on the inner surface of the lower sleeve.

In one embodiment, the mandrels may each be constructed of one piece. In another embodiment, the mandrels may each be constructed of two or more components. For example, as shown in FIG. 2A, the first mandrel may be constructed of three primary components, including: an outer sleeve 40 forming walls 32, 34, inner sleeve 42 and a lower sleeve 44 forming ledge 50. The primary components of the first mandrel may define the lateral walls of the annular hollow chamber. For example, lower sleeve 44 may threadedly connect with outer sleeve proximal to the lower end of outer sleeve. The inner wall of outer sleeve, above the connection point with lower sleeve, may define an outer wall of the annular hollow chamber. The inner sleeve may threadedly connect to outer sleeve, below the tubular connection and above the end wall. The outer wall of the inner sleeve may extend below the end wall to define an inner wall and of the annular hollow chamber.

In operation, the apparatus may produce a pressure signal that is detectable at surface, to indicate that WOB values have increased beyond an upper limit identified by the operator. Prior to incorporation of the body into the drill string, the operator may identify the upper limit and select a biasing member that will only fully compress when a force equal to the upper limit is applied thereto between the first and second mandrels to resist their complete compression and therefore the sealing of first part 52 and second part 58 based upon the spring's biasing strength. In particular, in operation with a spring selected based on the WOB upper limit, if the axial forces on the drill bit are greater than the biasing strength of the spring, the two sealing parts may move together and form a fluidic seal thus preventing the flow of fluids through the body. When this occurs a pressure pulse is created in the drilling fluids that can be detected at surface to indicate when WOB values have exceeded the upper limit.

For example, the body may be connected in-line with the drill string uphole from the drill bit and possibly other downhole elements. The body may be comprised of the first mandrel and the second mandrel. The second mandrel may insert into an inner bore of the first mandrel and the second mandrel may have a limited range of telescopic movement there within. For example, the second mandrel may telescope relative to the first mandrel through an extended position, an intermediate position and a compressed or sealing position. The position of second mandrel within the first mandrel may be the result of biasing member's resistance to compression, thereby causing second mandrel to extend towards an extended position. FIG. 2A depicts the second mandrel in a fully extended position. The sealing position is achieved when the second mandrel is positioned such that the second sealing member creates a fluidic seal with the first sealing part, as in FIG. 2B. The intermediate position of the second mandrel may be dictated by a balancing of the biasing member's biasing strength and the force applied to compress the spring, which during drilling is WOB.

With respect to the wellbore, it may be of interest to control the compression of the tool. In other words, it may be of interest to control any force that may overcome the biasing member hence driving the second mandrel further into the first mandrel.

Based upon the specific conditions of a given drilling site, the operator may determine an upper limit of WOB values for efficient drilling. The operator may select a biasing member with a specific resistance to compression that will allow the second mandrel to resonate in an intermediate position while actual WOB values remain below the upper limit. For example, in some operations a higher upper limit may be desired by the operator. In such a case, the operator may employ a biasing member with a greater biasing strength. In another drilling operation a lower upper limit may be desired by the operator. In such a case, the operator may employ a biasing member with a lower biasing strength.

For example, if an operator identifies 9000 deciNewtons (dN) as the upper limit of WOB values is appropriate for a given drilling scenario the biasing member may have a biasing strength of 9000 dN. In this example a 1:1 ratio of WOB upper limit values to biasing strength of the selected biasing member is described; however, the present invention does contemplate various other ratios of WOB upper limit to biasing strength. Variability in this ratio may depend upon the specific design of the first and second sealing members, the apparatus as a whole or any number of other factors relevant to a given drilling scenario.

Further, it is appreciated that in selecting a biasing member with the appropriate biasing strength a plurality of biasing members may be employed within annular hollow chamber 36. Pursuant to the present example, one biasing member with a biasing strength of 9000 dN may be employed. Alternatively, the operator may select two biasing members, each with a biasing strength of 4500 dN or the operator may select three biasing members, each with a biasing strength of 3000 dN and so on. The precise number of biasing members is not essential to the working of the present invention. It may, however, be desirable to ensure that the total biasing strength of all biasing members employed within annular hollow chamber meet the design-determined ratio of WOB upper limit values to biasing strength.

If WOB increases, the second mandrel may be driven against the resistance created by the biasing strength of the biasing member towards a sealing position. If WOB increases sufficiently to a value above the predetermined upper limit, termed sealing WOB, the biasing member's resistance to compression is fully overcome and second mandrel may move into a sealing position with the first and second sealing parts positioned to form a fluidic seal within the central bore.

In the sealing position, the matching profile of the second sealing member may engage and create a fluidic seal with the first sealing part, as shown in FIG. 2B, and thereby, preventing the flow of fluids there through. The fluidic seal may be created by the matching profile of the second sealing part blocking the central aperture of the first sealing part preventing the flow of fluids through the central bore of the tubular body.

The fluidic seal may prevent any fluid communication across the first sealing part so that, for example, all drilling fluids being pumped from surface down the central bore of the drill string will no longer communicate below the fluidic seal. The effect of creating such a fluidic seal, in the face of continued drilling fluid delivery from surface, is that a pressure signal may rapidly accumulate above the fluidic seal within the central bore (see flow line Y depicted in FIG. 2B). Such a pressure signal may be detected at surface.

In an alternative embodiment, flow of fluids through the seal may not be entirely prevented when the apparatus is in a sealing position. For example, the second sealing member may have apertures 63 that permit the continued, albeit restricted, flow of fluids through central bore 26 when the matching profile has engaged the first sealing part. In this embodiment, the flow through the central bore will be restricted to a degree that back pressure will develop above central aperture 53 and this back pressure may be of sufficient amplitude to be detectable at surface.

As drilling operations proceed, if the actual WOB values remain below the predetermined upper limit, the second mandrel may continue to resonate in an intermediate position and drilling fluids may pass by the first sealing part to lubricate and cool the drill bit while also clearing cuttings to surface. However, if WOB increases, the first mandrel may be pushed down against the biasing member. If actual WOB values exceed the upper limit, the biasing member's resistance to compression will be overcome and the first mandrel may move into a sealing position creating a fluidic seal between the first sealing part and second sealing member. The fluidic seal will prevent the flow of drilling fluids past the first sealing part, which may cause a pressure spike above the first sealing part. This pressure spike may be detectable at surface, so that the operator can identify when actual WOB has exceeded the upper limit and sealing WOB has been achieved. The operator may take the steps necessary, as appreciated by those skilled in the art of wellbore drilling, to decrease the WOB to cause the second mandrel to disengage the second sealing part from the first sealing part and return to an intermediate or extended position.

In an alternative embodiment, the driving pressure of the drilling fluids being pumped down from surface may be sufficiently high to disengage the first and second sealing members and push the apparatus out of a sealing position. In such an embodiment, the operator may observe a smaller duration of the pressure spike but a distinct pressure spike will still indicate when actual WOB has exceeded the upper limit so that the operator may take the steps necessary, as appreciated by those skilled in the art of wellbore drilling, to decrease the WOB.

In some instances the biasing member selected by the operator may have a relatively high resistance to compression. In these instances, the biasing member may cause the lower edge of the flange to contact the ledge violently when actual WOB values decrease. Such violent collisions may be mitigated by the dampener to cushion the impact between the second mandrel and the ledge to avoid damaging the apparatus and the drill string.

The first and second mandrel may be arranged so that torsional forces are transmitted between the two mandrels. For example, the lower sleeve may have one or more splines that engage and axially move within one or more receiving grooves on the outer wall of second mandrel that mate with the one or more splines, or vice versa, the one or more splines may be included on the outer wall of second mandrel and the one or more receiving grooves may be on the inner surface of the lower sleeve.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. An apparatus for signaling when a weight-on-bit value is greater than an upper limit during the drilling of wellbores, the apparatus comprising:

(a) a tubular body for connection within a drill string including a first mandrel and a second mandrel, and a central bore defining a longitudinal axis of the tubular body and creating a flow path permitting a flow of fluids between the two mandrels and through the tubular body, the second mandrel secured, at least partially, within an annular bore of the first mandrel so that the second mandrel is telescopically arranged with and axially moveable within the first mandrel between a telescopically extended position defining a first length and a compressed position having a length shorter than the first length;

(b) a biasing member that biases the first mandrel and the second mandrel into the telescopically extended position, the biasing member having a biasing strength; and (c) a first sealing part and a second sealing part; one sealing part being secured to the first mandrel and the other sealing part being secured to the second mandrel, both sealing parts being within the flow path of the tubular body, the first sealing part and the second sealing part being positioned to come together when the biasing strength of the biasing member is overcome by the weight-on-bit, together the sealing parts form a fluid seal in the central bore to resist the flow of fluids through the tubular body.

2. The apparatus of claim 1, the first mandrel further comprises an inner sleeve, an outer sleeve and a lower sleeve.

3. The apparatus of claim 1, further comprising a dampener to dampen any collision forces when the first mandrel and the second mandrel move into the telescopically extended position.

4. The apparatus of claim 1, wherein the first sealing part is a seat with a central aperture to permit the flow of fluids therethrough.

5. The apparatus of claim 1, wherein the second sealing part extends across the central bore and includes at least one port to permit the flow of fluids therethrough.

6. The apparatus of claim 1, wherein the first mandrel and second mandrel include connections to connect to the drill string.

7. The apparatus of claim 1 wherein the fluid seal prevents the flow of fluids through the tubular body.

8. The apparatus of claim 1 wherein the first part and the second part include a seat encircling the center bore and a protrusion portion to seal in the seat to create the fluid seal and further comprising an aperture for communication of restricted flow past the fluid seal when the fluid seal is formed in the central bore.

9. A method for detecting if weight-on-bit values exceed an upper limit during the drilling of wellbores, the method comprising:

(a) determining the upper limit of weight-on-bit values;

(b) selecting a biasing member strength at least equal to weight-on-bit values;

(c) providing an apparatus to produce a pressure signal including:

(i) a tubular body for connection within a tubular string including a first mandrel and a second mandrel, with a central bore defining a longitudinal axis of the body and permitting the flow of fluids between the two mandrels and through the tubular body; the second mandrel secured, at least partially, within an annular bore of the first mandrel so that the second mandrel is telescopically arranged with and axially moveable within the first mandrel between a telescopically extended position defining a first length and a compressed position having a length shorter than the first length;

(ii) a biasing member having the selected biasing member strength to bias the first mandrel and the second mandrel into the telescopically extended position; and (iii) a first sealing part and a second sealing part; one sealing part being secured to the first mandrel and the other sealing part being secured to the second mandrel, both sealing parts being within the fluid flow of the tubular body, the first sealing part and the second sealing part are positioned to come together when the biasing strength of the biasing member is overcome by the weight-on-bit, together the sealing parts form a fluid seal in the central bore to resist the flow of fluids through the tubular body;

(d) connecting the apparatus in-line with a drill string so that the position of the second mandrel in the first mandrel is dependent upon the balance of the biasing strength of the biasing member and an axial driving force on a drill bit;

(e) applying torsional and axial forces on the drill string to drill a wellbore;

(f) pumping of drilling fluids through the drill string; and (g) monitoring drilling fluid pressure to detect the pressure signal indicative of the formation of the fluid seal in the apparatus.

10. The method of claim 9, wherein the applying of torsional forces includes transmitting rotational energy through the apparatus.

11. The method of claim 9, further comprising reducing the weight-on-bit after detecting the fluid seal.

12. The method of claim 9 wherein the fluid seal prevents the flow of fluids through the tubular body.

13. A method for determining that a weight-on-bit value has exceeded an upper limit during the drilling of a wellbore, the method comprising:

(a) drilling the wellbore with a drill string including an apparatus including:

(i) a tubular body including a first mandrel, a second mandrel and a central bore extending through the first mandrel and the second mandrel and defining a longitudinal axis of the tubular body, the central bore permitting a flow of fluids through the tubular body; the first mandrel and the second mandrel being telescopically connected and axially moveable between a telescopically extended position defining a first length and a compressed position having a length shorter than the first length;

(ii) a first sealing part secured to the first mandrel and a second sealing part secured to the second mandrel, the first sealing part and the second sealing part being within the central bore and positioned (i) to allow a flow of fluid through the central bore when the tubular body is in the telescopically extended position and (ii) to come together to form a fluid seal to resist the flow of fluids through the central bore when the tubular body is in the compressed position; and, (iii) a biasing member to bias the first mandrel and the second mandrel into the telescopically extended position and having a biasing strength to be overcome to allow the first sealing part and the second sealing part to form the fluid seal when the weight-on-bit upper limit is exceeded, the apparatus being connected in-line with the drill string so that movement of the tubular body between the telescopically extended position and the compressed position is dependent on the balance of the biasing strength of the biasing member and the weight-on-bit of the drill string;

(b) applying torsional and axial forces on the drill string to drill the wellbore;

(c) pumping drilling fluids through the drill string; and (d) monitoring drilling fluid pressure to detect a pressure pulse indicative of the formation of the fluid seal in the apparatus.

14. The method of claim 13, wherein the applying of torsional forces includes transmitting rotational energy through the apparatus.

15. The method of claim 13, further comprising reducing the weight-on-bit after detecting the fluid seal.

16. The method of claim 13 wherein the fluid seal prevents the flow of fluids through the tubular body.

* * * * *